US008434842B2

(12) United States Patent
Matsuo

(10) Patent No.: US 8,434,842 B2
(45) Date of Patent: May 7, 2013

(54) LIQUID EJECTING APPARATUS AND METHOD OF CONTROLLING LIQUID EJECTING APPARATUS

(75) Inventor: Hiroyuki Matsuo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 234 days.

(21) Appl. No.: 12/891,934

(22) Filed: Sep. 28, 2010

(65) Prior Publication Data

US 2011/0096111 A1 Apr. 28, 2011

(30) Foreign Application Priority Data

Oct. 22, 2009 (JP) ..... 2009-243271

(51) Int. Cl.
*B41J 29/38* (2006.01)

(52) U.S. Cl.
USPC ..... 347/10

(58) Field of Classification Search ..... None
See application file for complete search history.

(56) References Cited

U.S. PATENT DOCUMENTS 6,290,315 B1 * 9/2001 Sayama ..... 347/10
2003/0085962 A1 * 5/2003 Junhua ..... 347/68
2009/0247669 A1 * 10/2009 Jung et al. ..... 523/202

FOREIGN PATENT DOCUMENTS

JP 2006-142588 6/2006

* cited by examiner

*Primary Examiner* — Geoffrey Mruk
(74) *Attorney, Agent, or Firm* — Workman Nydegger

(57) ABSTRACT

A potential inclination of the second variation component in the liquid-kind ejection pulse of the first signal is gentler than a potential inclination of the first variation component. A potential inclination of the second variation component in the liquid-kind ejection pulse of the second signal is steeper than the potential inclination of the first variation component. A ratio of the potential of the intermediate hold component to the potential of the hold section is larger in the liquid-kind ejection pulse of the second signal than in the liquid-kind ejection pulse of the first signal.

5 Claims, 7 Drawing Sheets

LIQUID EJECTING APPARATUS AND METHOD OF CONTROLLING LIQUID EJECTING APPARATUS

The entire disclosure of Japanese Patent Application No: 2009-243271, filed Oct. 22, 2009 are expressly incorporated by reference herein.

BACKGROUND

1. Technical Field

The present invention relates to a liquid ejecting apparatus such as an ink jet printer and a method of controlling the liquid ejecting apparatus, and more particularly, to a liquid ejecting apparatus capable of controlling ejection of a liquid by applying an ejection driving pulse to a pressure generation unit and a method of controlling the liquid ejecting apparatus.

2. Related Art

A liquid ejecting apparatus is an apparatus which includes a liquid ejecting head having nozzles ejecting a liquid and ejects various kinds of liquids from the liquid ejecting head. A representative example of the liquid ejecting apparatus is an image printing apparatus such as an ink jet printer (hereinafter, simply referred to as a printer) which includes an ink jet print head (hereinafter, simply referred to as a print head) as a liquid ejecting head and prints an image or the like by ejecting and landing liquid-like ink from nozzles of the print head on a print medium (landing target) to form dots. In recent years, the liquid ejecting apparatus has been applied not only to the image printing apparatus, but also various manufacturing apparatuses such as an apparatus manufacturing a color filter such as a liquid crystal display.

For example, a printer includes a nozzle row (nozzle group) in which a plurality of nozzles are arranged. In the printer, an ejection driving pulse is applied to a pressure generation unit (for example, a piezoelectric vibrator or a heating device) to drive the pressure generation unit, and a pressure variation is applied to a liquid in a pressure chamber to eject the liquid from the nozzles communicating the pressure chamber. In a printer using a piezoelectric vibrator as a pressure generation unit, in general, ink is ejected from nozzles by first expanding a pressure chamber preliminarily (expansion step), holding the expansion state for a given time (hold step), and then rapidly contracting the pressure chamber (contraction step) to pressurize the ink in the pressure chamber (for example, see JP-A-2006-142588).

However, a printer is configured to eject different kinds of ink, for example, black ink formed of self-dispersion type pigment and color ink formed of resin dispersion type pigment. The self-dispersion pigment is a pigment which can be dispersed or dissolved in a solvent without using a surface acting agent or a dispersion agent such as resin. An example of the self-dispersion pigment includes carbon black ink. The resin dispersion type pigment is a pigment which is dispersed in a solvent using a water-soluble resin, such as an acryl-based resin, methacryl-based resin, vinyl acetate resin, or styrene-acryl-based resin, as a dispersion agent. The resin dispersion type pigment is mainly used for color ink. The ink formed of the resin-dispersion type pigment has the feature that when the ink is ejected under the same conditions, the rear end portion of the ejected ink tends to become a tailed portion like a tail, compared to the ink formed of the self-dispersion type pigment.

That is, when the color ink of which the rear end portion easily becomes a tailed portion is ejected in the configuration in which the black ink and the color ink are ejected using a driving signal (ejection pulse), the rear end tail portion of a preceding main liquid droplet is separated from the main liquid droplet and becomes a satellite liquid droplet in some cases. In the configuration in which the print head is moved relative to the print medium to perform printing, the landing positions of the main liquid droplet and satellite droplet on a print medium are distant from each other. A difference between the landing positions of the main liquid droplet and the satellite liquid droplet may deteriorate the quality of a printed image.

SUMMARY

An advantage of some aspects of the invention is that it provides a liquid ejecting apparatus capable of preventing a difference between the landing positions of a satellite liquid droplet and a main liquid droplet on a landing target when different kinds of liquids are ejected, and a method of controlling the liquid ejecting apparatus.

According to an aspect of the invention, there is provided a liquid ejecting apparatus including: a liquid ejecting head which includes a nozzle ejecting a liquid, a pressure chamber communicating with the nozzle, and a pressure generation unit applying pressure variation to the liquid of the pressure chamber and which ejects the liquid from the nozzle by an operation of the pressure generation unit; a driving control unit which generates a driving signal containing an ejection pulse used to eject the liquid from the nozzle and controls driving of the pressure generation unit; and a movement unit which moves the liquid ejecting head relative to a landing target. A first liquid and a second liquid different from the first liquid are ejected. The driving signal includes a first signal used to eject the first liquid and a second signal used to eject the second liquid. The first and second signals each include a liquid-kind ejection pulse having a first variation section in which a potential is varied in a first direction, a hold section in which a termination potential of the first variation section holds for a given time, and a second variation section in which the potential is varied in a second direction opposite to the first direction. The second variation section includes a first variation component in which the potential is varied in the second direction from the termination potential of the first variation section, an intermediate hold component in which the termination potential of the first variation component holds for a given time, and a second variation component in which the potential is varied in the second direction from the termination potential of the first variation component. A potential inclination of the second variation component in the liquid-kind ejection pulse of the first signal is gentler than a potential inclination of the first variation component. A potential inclination of the second variation component in the liquid-kind ejection pulse of the second signal is steeper than the potential inclination of the first variation component. A ratio of the potential of the intermediate hold component to the potential of the hold section is larger in the liquid-kind ejection pulse of the second signal than in the liquid-kind ejection pulse of the first signal.

According to this aspect of the invention, the driving signal includes the first signal used to eject the first liquid and the second signal used to eject the second liquid. The first and second signals each include a liquid-kind ejection pulse having a first variation section in which a potential is varied in a first direction, a hold section in which a termination potential of the first variation section holds for a given time, and a second variation section in which the potential is varied in a second direction opposite to the first direction. The second variation section of the ejection pulse includes a first variation component in which the potential is varied in the second direction from the termination potential of the first variation section, an intermediate hold component in which the termination potential of the first variation component holds for a given time, and a second variation component in which the potential is varied in the second direction from the termination potential of the first variation component. The potential inclination of the second variation component in the liquid-kind ejection pulse of the first signal is gentler than the potential inclination of the first variation component. The potential inclination of the second variation component in the liquid-kind ejection pulse of the second signal is steeper than the potential inclination of the first variation component. The ratio of the potential of the intermediate hold component to the potential of the hold section is larger in the liquid-kind ejection pulse of the second signal than in the liquid-kind ejection pulse of the first signal. When a tailed portion occurs more easily in the second liquid than in the first liquid, the flying speed of a main liquid droplet upon ejecting the second liquid by the liquid-kind ejection pulse of the second signal can be made slower and the flying speed of a satellite liquid droplet can be made more rapid than that of the main liquid droplet, compared to a case where the first liquid is ejected by the liquid-kind ejection pulse of the first signal. Therefore, since the distance between the main liquid droplet and the satellite liquid droplet can be reduced while the main liquid droplet and the satellite liquid droplet are landed on the landing target, the tailed portion is suppressed. As a consequence, a difference between the landing positions of the main liquid droplet and the satellite liquid droplet on the landing target is suppressed. Therefore, the forms of dots on the landing target can be arranged constantly, irrespective of the kinds of ink.

In the liquid ejecting apparatus having the above-described configuration, the first and second signals may each include a preceding ejection pulse generated first and the liquid-kind ejection pulse subsequent to the preceding ejection pulse in a unit period separated by a timing signal defining a repetition period of the driving signal. A flying speed of the liquid ejected by the preceding ejection pulse may be set to be slower than a flying speed of the liquid ejected by the liquid-kind ejection pulse, and the liquid ejected by the preceding ejection pulse and the liquid ejected by the liquid-kind ejection pulse may be integrated to each other on the landing target.

With such a configuration, when the liquids are ejected from the nozzle by continuously applying the preceding ejection pulse and the liquid-kind ejection pulse in the unit period to the pressure generation unit, the preceding liquid and the subsequent liquid are integrated to each other on the landing target. Therefore, the difference between the landing positions on the landing target is suppressed. In this way, in the configuration in which gray scale expression is realized in accordance with the number of ink ejected in the unit period, the quality of a printed image can be improved.

In the liquid ejecting apparatus having the above-described configuration, an interval between the preceding ejection pulse and the liquid-kind ejection pulse of the first signal may be in the range from 1.4 Tc to 1.6 Tc. An interval between the preceding ejection pulse and the liquid-kind ejection pulse of the second signal may be in the range from 1.1 Tc to 1.2 Tc.

With such a configuration, the interval between the preceding ejection pulse and the liquid-kind ejection pulse of the first signal may be in the range from 1.4 Tc to 1.6 Tc. In addition, the interval between the preceding ejection pulse and the liquid-kind ejection pulse of the second signal may be in the range from 1.1 Tc to 1.2 Tc. Therefore, in the second signal, the flying speed of the second liquid (particularly, the main liquid droplet) ejected by the liquid-kind ejection pulse can be suppressed from being increased due to the influence of the residual vibration after the second liquid is ejected by the preceding ejection pulse. In this way, the tailed portion occurring upon ejecting the second liquid can be further suppressed.

In the liquid ejecting apparatus having the above-described configuration, the first liquid may be a liquid to which a self-dispersion type pigment is added, and the second liquid may be a liquid to which a resin dispersion type pigment and a dispersion agent is added.

According to another aspect of the invention, there is provided a method of controlling a liquid ejecting apparatus including a liquid ejecting head which includes a nozzle ejecting a liquid, a pressure chamber communicating with the nozzle, and a pressure generation unit applying pressure variation to the liquid of the pressure chamber and which ejects the liquid from the nozzle by an operation of the pressure generation unit, a driving control unit which generates a driving signal containing an ejection pulse used to eject the liquid from the nozzle and controls driving of the pressure generation unit, and a movement unit which moves the liquid ejecting head relative to a landing target. The liquid ejecting apparatus is capable of ejecting a first liquid and a second liquid different from the first liquid. The driving signal includes a first signal used to eject the first liquid and a second signal used to eject the second liquid. The first and second signals each include a liquid-kind ejection pulse having a first variation section in which a potential is varied in a first direction, a hold section in which a termination potential of the first variation section holds for a given time, and a second variation section in which the potential is varied in a second direction opposite to the first direction. The second variation section includes a first variation component in which the potential is varied in the second direction from the termination potential of the first variation component, an intermediate hold component in which the termination potential of the first variation component holds for a given time, and a second variation component in which the potential is varied in the second direction from the termination potential of the first variation component. A ratio of the potential of the intermediate hold component to the potential of the hold section is larger in the liquid-kind ejection pulse of the second signal than in the liquid-kind ejection pulse of the first signal. The method includes: a first variation step of varying the volume of the pressure chamber in the first variation section; a hold step of holding the volume of the pressure chamber varied in the first variation step for a predetermined time in the hold section; and a second variation step of varying the volume of the pressure chamber varied in the first variation step in the second variation section. The second variation step includes: a first variation action of varying the volume of the pressure chamber varied in the first variation step to a halfway volume in the first variation component; a hold action of holding the volume of the pressure chamber varied in the first variation action for a given time; and a second variation action of varying the volume of the pressure chamber holding in the hold action in the second variation component. A variation speed of the volume of the pressure chamber in the second variation action by the liquid-kind ejection pulse of the first signal is slower than a variation speed of the volume of the pressure chamber in the first variation action. A variation speed of the volume of the pressure chamber in the second variation action by the liquid-kind ejection pulse of the second signal is more rapid than a variation speed of the volume of the pressure chamber in the first variation action.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings. Although the following embodiment is described as a preferred specific example of the invention in various forms, the scope of the invention is not limited to the forms as long as the description limiting the invention is clearly not mentioned. In the following description, an ink jet printing apparatus (hereinafter, referred to as a printer) will be described as an example of a liquid ejecting apparatus of the invention.

Figure 1:
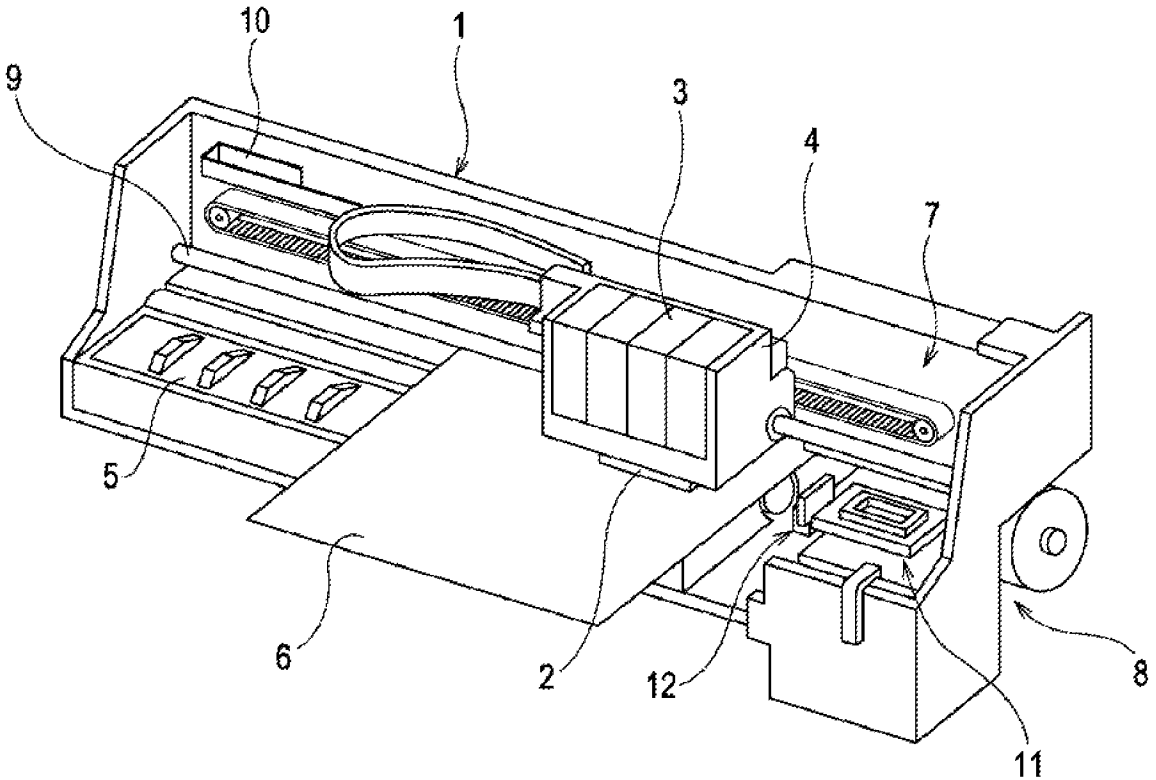
FIG. 1 is a perspective view illustrating the overall configuration of a printer.

FIG. 1 is a perspective view illustrating the configuration of a printer 1. The printer 1 is mounted with a print head 2 as a liquid ejecting head and includes a carriage 4 detachably mounted with ink cartridges 3, a platen 5 disposed below the print head 2, a carriage moving mechanism 7 (which is a kind of movement unit) reciprocating the carriage 4 in a sheet surface direction of a print sheet 6 (which is a kind of landing target) as a printing medium, that is, a main scanning direction, and a sheet transporting mechanism 8 transporting the print sheet 6 in a sub-scanning direction perpendicular to the main scanning direction.

The ink cartridge 3 is an ink storage member (liquid storage member) or a member serving as a liquid supply source. In this embodiment, a total of four ink cartridges 3 storing black ink (K), cyan ink (C), magenta ink (M), and yellow ink (Y), respectively, are mounted on the carriage 4. Here, the black ink is a self-dispersion type pigment ink and corresponds to a first liquid in this embodiment. Color ink other than the black ink is resin dispersion type pigment ink and corresponds to a second liquid in this embodiment. Therefore, the printer 1 is configured to execute printing of an image on a landing target such as the print sheet 6 using different kinds of ink.

The carriage 4 is mounted on a guide rod 9 installed so as to be shaft-supported in the main scanning direction. Therefore, the carriage 4 is moved along the guide rod 9 in the main scanning direction by an operation of the carriage moving mechanism 7. The position of the carriage 4 in the main scanning direction is detected by a linear encoder 10. The detection signal, that is, an encoder pulse EP is transmitted to a control unit 41 (see FIG. 3) of a printer controller 35. With such a configuration, the control unit 41 can control a printing process (ejecting process) executed by the print head 2, while recognizing the scanning position of the carriage 4 (print head 2) on the basis of the encoder pulse EP from the linear encoder 10.

A home position serving as a base point of the scanning is set in an end region outside a print area within the movement range of the carriage 4. A capping member 11 sealing a nozzle formation surface (nozzle substrate 21: see FIG. 2) of the print head 2 and a wiper member 12 cleaning the nozzle formation surface are disposed at the home position according to this embodiment. The printer 1 is configured to be capable of executing so-called bi-directional printing of characters, an image, or the like on the print sheet 6 in both directions at forward movement time, at which the carriage 4 (print head 2) is moved toward the opposite end of the home position and at backward movement time, at which the carriage 4 is returned from the opposite end to the home position.

Figure 2:
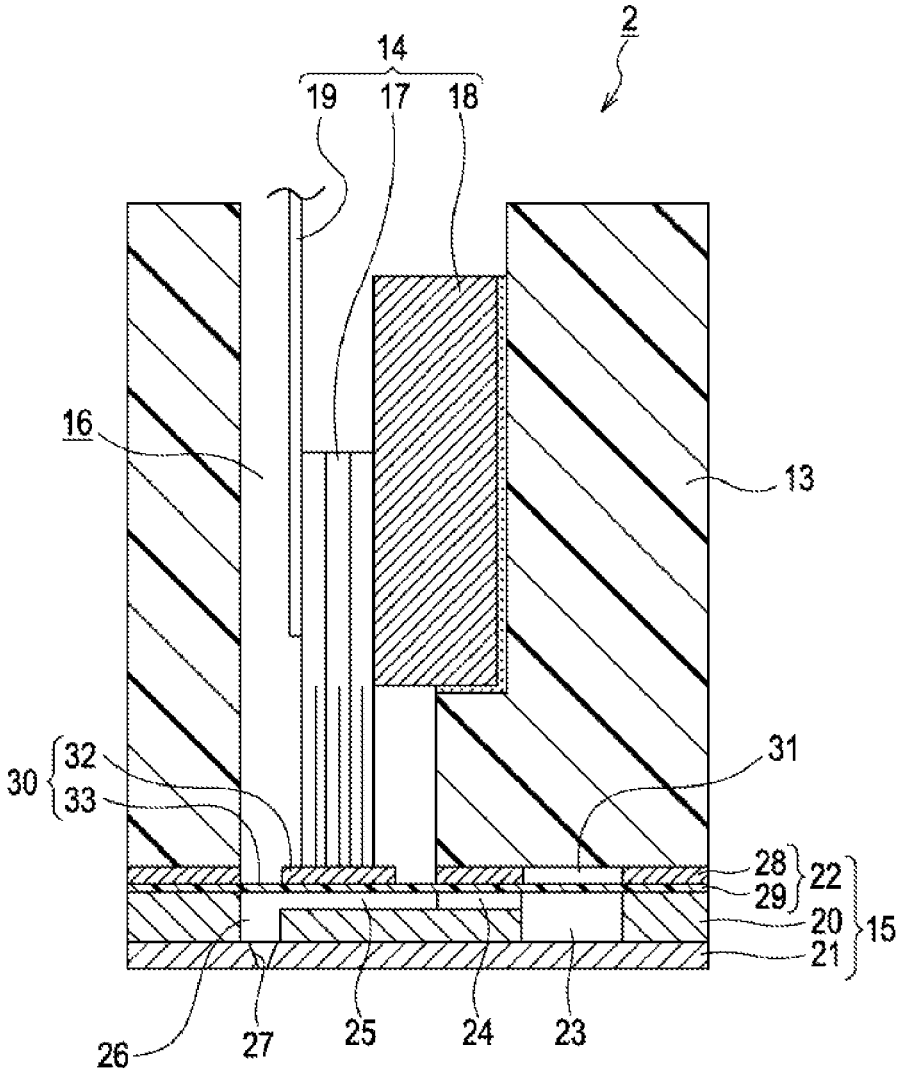
FIG. 2 is a sectional view illustrating the configuration of the main units of a print head.

FIG. 2 is a sectional view illustrating the configuration of the main units of the print 2. The print head 2 includes a case 13, a vibrator unit 14 received in the case 13, and a passage unit 15 joining to the bottom surface (front end surface) of the case 13. The case 13 is formed of, for example, epoxy-based resin. A receiving hollow portion 16 is formed in the case 13 to receive the vibrator unit 14. The vibrator unit 14 includes a piezoelectric vibrator 17 serving as a kind of pressure generation unit, a fixing plate 18 to which the piezoelectric vibrator 17 joins, and a flexible cable 19 supplying a driving signal or the like to the piezoelectric vibrator 17. The piezoelectric vibrator 17 is of a laminated type manufactured by separating a piezoelectric plate, which is formed by alternately laminating piezoelectric layers and electrode layers, in a pectinate form and is a vertical vibration mode piezoelectric vibrator expanded or contracted in a direction perpendicular to the lamination direction.

The passage unit 15 is formed by joining the nozzle substrate 21 to one surface of the passage substrate 20 and joining an elastic plate 22 on the other surface of the passage substrate 20. A reservoir 23, an ink supply port 24, a pressure chamber 25, a nozzle communication opening 26, and a nozzle 27 are formed in the passage unit 15. A series of ink passages from the ink supply port 24 to the nozzle 27 via the pressure chamber 25 and the nozzle communication opening 26 is formed to correspond to each nozzle 27.

The nozzle substrate 21 is a plate member formed of a metal plate made of stainless steel, a silicon single-crystal substrate, or the like, where a plurality of the nozzles 27 is punched in a row form at a pitch (for example, 180 dpi) corresponding to a dot formation density. In the nozzle substrate 21, a plurality of rows (nozzle groups) of the nozzles 27 is formed and 180 nozzles 27, for example, organize one nozzle row. The print head 2 according to this embodiment is configured to mount four ink cartridges 3 storing ink (which is a kind of liquid) of respective different colors, specifically, a total of four of cyan (C) ink, magenta (M) ink, yellow (Y) ink, and black (K) ink. Therefore, a total of four nozzle rows are formed in the nozzle substrate 21 so as to correspond to these colors.

The elastic plate 22 has a double structure in which an elastic film 29 is laminated on the surface of a support plate 28. In this embodiment, the elastic plate 22 is manufactured using a composite plate member formed by laminating a stainless steel plate, which is a kind of metal plate, as the support plate 28 and a resin film as the elastic film 29 on the surface of the support plate 28. The elastic plate 22 is provided with a diaphragm portion 30 varying the volume of the pressure chamber 25. The elastic plate 22 is provided with a compliance portion 31 sealing a part of the reservoir 23.

The diaphragm portion 30 is manufactured by partially removing the support plate 28 by etching. That is, the diaphragm portion 30 includes an island portion 32 to which the front end surface of the piezoelectric vibrator 17 joins and a thin-walled elastic portion 33 surrounding the island portion 32. The compliance portion 31 is manufactured by removing the support plate 28 of a region facing an opening surface of the reservoir 23 by etching, as in the diaphragm portion 30. The compliance portion 31 functions as a damper absorbing a variation in the pressure of a liquid stored in the reservoir 23.

Since the front end surface of the piezoelectric vibrator 17 joins to the island portion 32, the volume of the pressure chamber 25 can be varied by expansion or contraction of a free end portion of the piezoelectric vibrator 17. With the variation in the volume, a variation in the pressure of the ink in the pressure chamber 25 is caused. The print head 2 ejects ink droplets from the nozzles 27 using the variation in the pressure.

Figure 3:
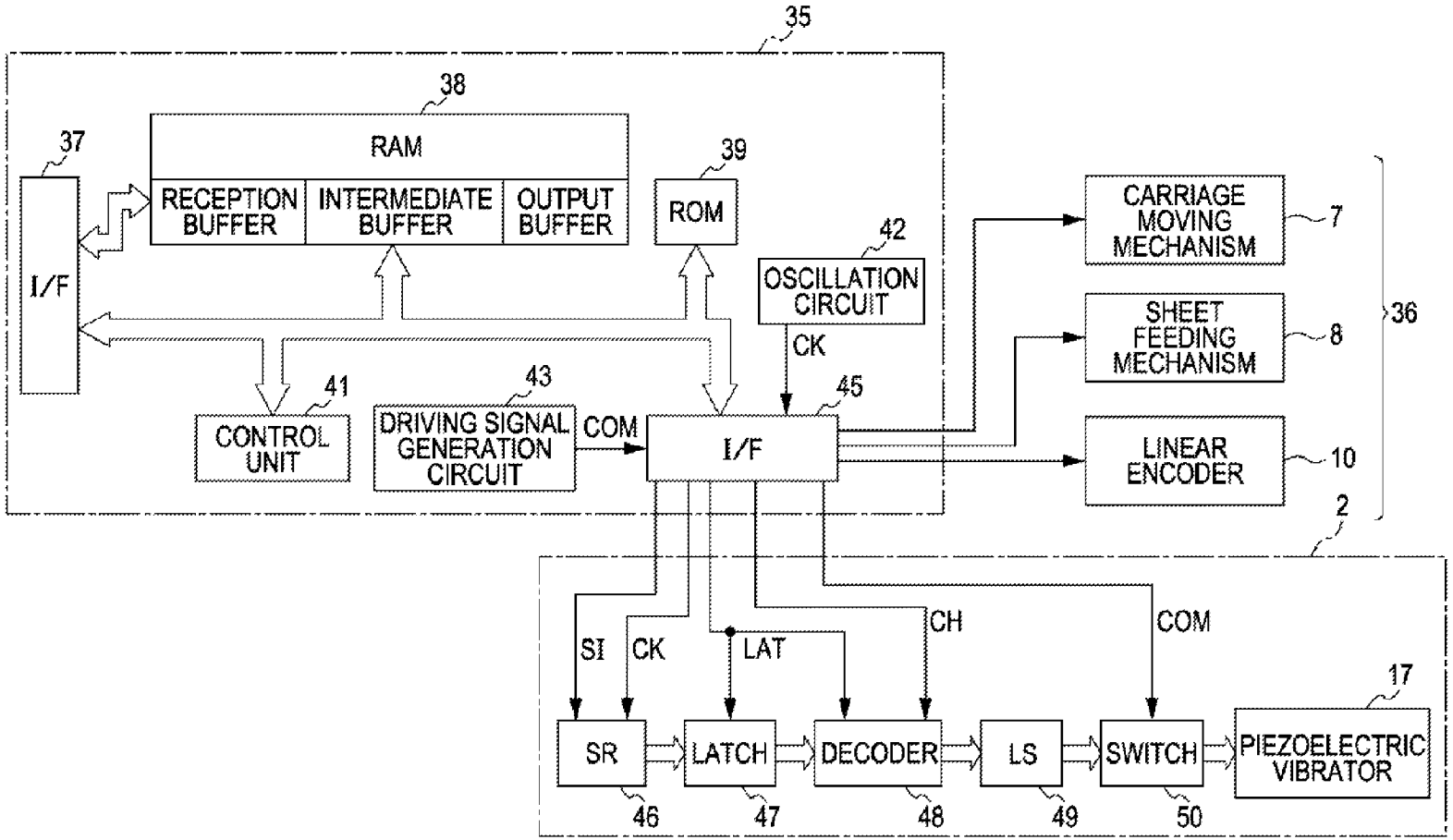
FIG. 3 is a block diagram illustrating the electric configuration of the printer.

FIG. 3 is a block diagram illustrating the electric configuration of the printer 1. The printer 1 includes the printer controller 35 and a print engine 36 as a whole. The printer controller 35 corresponds to a driving control unit according to the invention. The printer controller 35 generates the driving signal COM containing the ejection pulses used to eject the ink from the nozzles 27 of the print head 2 and controls the driving of the piezoelectric vibrator 17 using the driving signal COM. The printer controller 35 includes an external interface (external I/F) 37 into which print data or the like is input from an external apparatus such as a host computer, a RAM 38 which stores a variety of data or the like, a ROM 39 which stores a control routine to process a variety of data, the control unit 41 which controls each unit, an oscillation circuit 42 which generates a clock signal, a driving signal generation circuit 43 which generates a driving signal to be supplied to the print head 2, and an internal interface (internal I/F) 45 which outputs pixel data obtainable by developing the print data into each dot and the driving signal to the print head 2.

Figure 4:
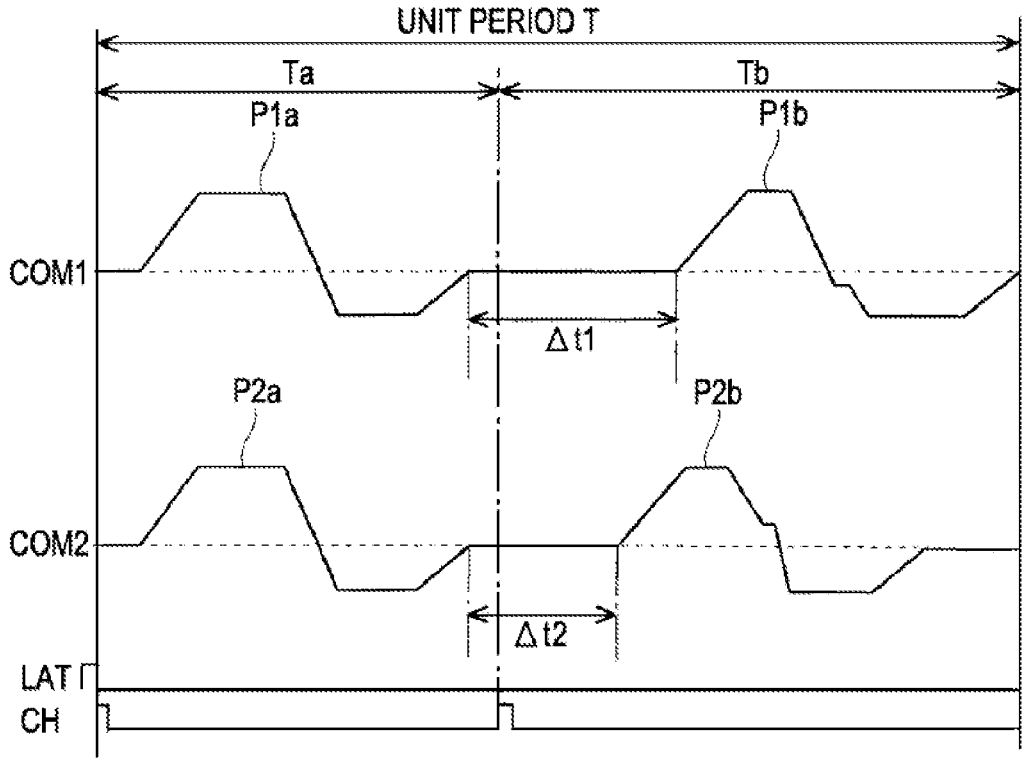
FIG. 4 is a diagram illustrating the waveform of a driving signal.

The control unit 41 outputs a head control signal to control the operation of the print head 2 to the print head 2 or outputs a control signal used to generate driving signals COM (a first signal COM1 and a second signal COM2) to the signal generation circuit 43. The control unit 41 serves as a timing pulse generation unit generating a timing pulse PTS from the encoder pulse EP. The timing pulse PTS is a signal defining the start timing of the driving signals COM generated by the driving signal generation circuit 43. The driving signal generation circuit 43 outputs the driving signal COM whenever receiving the timing pulse PTS. In other words, the driving signals COM are generated at unit period T separated by the timing pulse PTS. The control unit 41 outputs a latch signal LAT or a change signal CH to the print head 2 in synchronization with the timing pulse PTS. As shown in FIG. 4, the latch signal LAT is a signal defining the start timing of the unit period T, that is, the repetition period of the driving signal COM. The change (channel) signal CH defines the supply start timing of each ejection pulse included in the driving signals COM (the first signal COM1 and the second signal COM2).

The control unit 41 executes a color conversion process of converting the RGB color system to the CMYK color system, a halftone process of reducing multiple gray-scale data down to a predetermined gray scale, and a dot pattern development process of arranging the data subjected to the halftone process in a predetermined arrangement form in each kind of ink (each nozzle row) and developing the data into dot pattern data to generate the pixel data SI used to control the ejection of the print head 2. The pixel data SI is data regarding pixels of an image to be printed and is a kind of ejection control information. Here, the pixels indicate a dot formation area imaginarily defined on a print medium such as a print sheet which is a landing target. The pixel data SI according to the invention is formed from gray scale data regarding whether dots formed on the print medium are formed (or whether ink is ejected) and regarding the size of the dot (amount of ink ejected). In this embodiment, the pixel data SI is organized by binary gray-scale data having a total of two bits.

The driving signal generation circuit 43 is a kind of driving signal generation unit and generates a series of driving signals containing a plurality of ejection pulses (driving waveforms). As shown in FIG. 4, the driving signal generation circuit 43 generates the first signal COM1 used to eject the black ink and the second signal COM2 used to eject color ink other than the black ink. The ejection pulse contained in each signal is a pulse used to eject a defined amount of ink from the nozzles 27 of the print head 2. The driving signals COM1 and COM2 exemplified in FIG. 4 each contain two ejection pulses in one unit period T. The driving signals COM will be described in detail below.

Next, the configuration of the print engine 36 will be described. The print engine 36 includes the print head 2, the carriage moving mechanism 7, the sheet feeding mechanism 8, and the linear encoder 10. The print head 2 includes a plurality of shift registers (SR) 46, a plurality of latches 47, a plurality of decoders 48, a plurality of level shifters (LS) 49, a plurality of switches 50, and a plurality of piezoelectric vibrators 17 so as to correspond to the nozzles 27, respectively. The pixel data (SI) from the printer controller 35 is synchronized with the clock signal (CK) from the oscillation circuit 42 and is transmitted in series to the shift registers 46.

The latch 47 is electrically connected to the shift register 46. Therefore, when the latch signal (LAT) is input from the printer controller 35, the latch 47 latches the pixel data of the shift register 46. The pixel data latched by the latch 47 is input to the decoder 48. The decoder 48 translates the 2-bit pixel data and generates pulse selection data. The pulse selection data according to this embodiment is formed by data of a total of two bits.

The decoder 48 outputs the pulse selection data to the level shifter 49 when receiving the latch signal (LAT) or a channel signal (CH). In this case, the pulse selection data is input to the level shifter 49 in order from an upper bit. The level shifter 49 functions as a voltage amplifier. Therefore, when the pulse selection data is "1", the level shifter 49 outputs a voltage enabling the driving of the switch 50, for example, an electric signal boosted to a voltage with about several tens of volts. The pulse selection data of "1" boosted by the level shifter 49 is supplied to the switch 50. The driving signal COM from the driving signal generation circuit 43 is supplied to the input side of the switch 50, and the piezoelectric vibrator 17 is connected to the output side of the switch 50.

The pulse selection data is used to control the operation of the switch 50, that is, the supply of an ejection pulse of the driving signal to the piezoelectric vibrator 17. For example, for a period in which the pulse selection data input to the switch 50 is "1", the switch 50 is in a connection state, the corresponding ejection pulse is supplied to the piezoelectric vibrator 17, and the potential level of the piezoelectric vibrator 17 is varied in accordance with the waveform of the ejection pulse. On the other hand, in a period in which the pulse selection data is "0", an electric signal enabling the operation of the switch 50 is not output from the level shifter 49. Therefore, since the switch 50 is in a disconnection state, no ejection pulse is supplied to the piezoelectric vibrator 17.

FIG. 4 is a diagram illustrating the waveform of the driving signals COM (COM1 and COM2) according to this embodiment. The driving signals COM according to this embodiment include the first signal COM1 for the black ink and the second signal COM2 for the color ink, as described above. As for the driving signals, the unit period T is separated into two of preceding time Ta and subsequent Tb by the change signals CH. In the first signal COM1, a first ejection pulse P1*a* (corresponding to a preceding ejection pulse) is generated at the time Ta and a second ejection pulse P1*b* (liquid-kind ejection pulse) is generated at the time Tb. In the second signal COM2, a third ejection pulse P2*a* (corresponding to a preceding ejection pulse) is generated at time Ta and a fourth ejection pulse P2*b* (liquid-kind ejection pulse) is generated at the time Tb. The second ejection pulse P1*b* of the first signal COM1 and the fourth ejection pulse P2*b* of the second signal COM2 are not singly applied to the piezoelectric vibrator 17, but are used in various combinations with the first ejection pulse P1*a* or the third ejection pulse P2*a* to form large dots, as described below.

Figure 5:
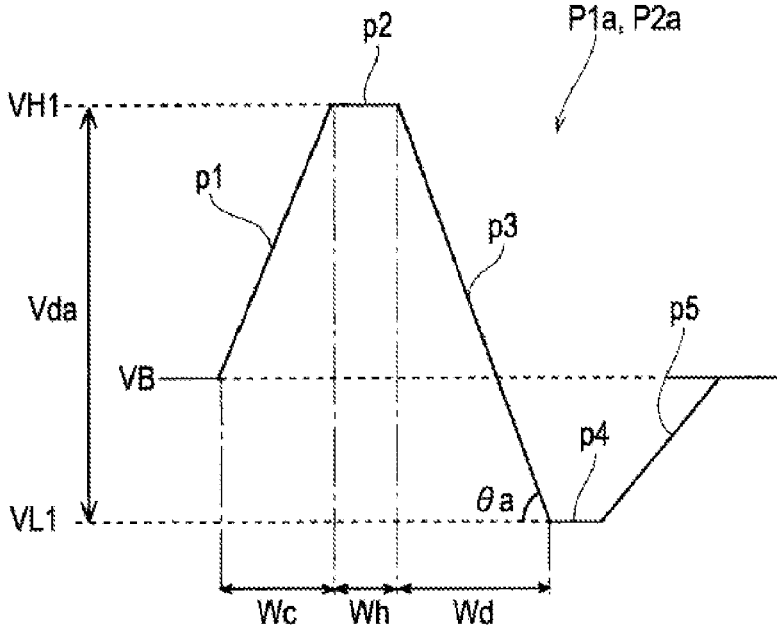
FIG. 5 is a diagram illustrating the waveform structure of a first ejection pulse and a third ejection pulse.

The first ejection pulse P1*a* of the first signal COM1 and the third ejection pulse P2*a* of the second signal COM2 are the same waveform as each other, and each includes a preliminary expansion section p1, an expansion hold section p2, a contraction section p3, a contraction hold section p4, and a return expansion section p5, as shown in FIG. 5. The preliminary expansion section p1 is a waveform section in which a potential increases at a constant inclination in a plus direction (corresponding to a first direction) from a reference potential VB to a first expansion potential VH1. The expansion hold section p2 is a waveform section in which the first expansion potential VH1, which is the termination potential of the preliminary expansion section p1, is constant. The contraction section p3 is a waveform section in which the potential decreases (drops) in a minus direction (corresponding to a second direction) from the first expansion potential VH1 to a first contraction potential VL1. The contraction hold section p4 is a waveform section in which the first contraction potential VL1 is constant. The return expansion section p5 is a waveform in which the potential returns from the first contraction potential VL1 to the reference potential VB.

When the ejection pulses P1*a* and P2*a* having the above-described structure are supplied to the piezoelectric vibrator 17, the piezoelectric vibrator 17 is first contracted in an element longitudinal direction in the preliminary expansion section p1, and thus the pressure chamber 25 is expanded from a reference volume corresponding to the reference potential VB to an expansion volume corresponding to the first expansion potential VH1. By the expansion, the surface (meniscus) of the ink in the nozzle 27 is considerably drawn toward the pressure chamber 25 and the ink in the pressure chamber 25 is supplied from the reservoir 23 via the ink supply port 24. Then, the expansion state of the pressure chamber 25 holds for the entire supply period of the expansion hold section p2. After the expansion state holds by the expansion hold section p2, the contraction section p3 is supplied and thus the piezoelectric vibrator 17 is expanded in response to the supply of the expansion section p3. Then, the pressure chamber 25 is contracted from the expansion volume to a contraction volume corresponding to the first contraction potential VL1. Therefore, the ink in the pressure chamber 25 is pressurized, the middle portion of the meniscus is extruded toward the ejection side, and thus the extruded portion grows in the form of a liquid column.

Thereafter, the contraction state of the pressure chamber 25 holds for a given time in the contraction hold section p4. Meanwhile, the liquid column in the middle portion of the meniscus is separated from the meniscus and is ejected as an ink droplet from the nozzle 27. Then, the ink droplet is landed on the print sheet 6, and a dot with a size corresponding to the middle dot is formed. The potential inclination (potential variation amount of about unit time) of the contraction section p3 in the ejection pulses P1*a* and P2*a* is set to be gentler than the potential inclination of each component of the contraction p3 of the ejection pulses P1*b* and P2*b*, which is described below. In this way, a flying speed Vma of the ink ejected from the nozzle 27 using the ejection pulses P1*a* and P2*a* is configured to be slower than the flying speed of the ink ejected by the ejection pulses P1*b* and P2*b*. The pressure of the ink in the pressure chamber 25, which has been decreased by the ejection of the ink, is increased again by the inherent vibration. When the return expansion section p5 is applied to the piezoelectric vibrator 17 at the increase timing, the pressure chamber 25 is expanded and the volume of the pressure chamber 25 is returned from the contraction volume to the normal volume.

Figure 6:
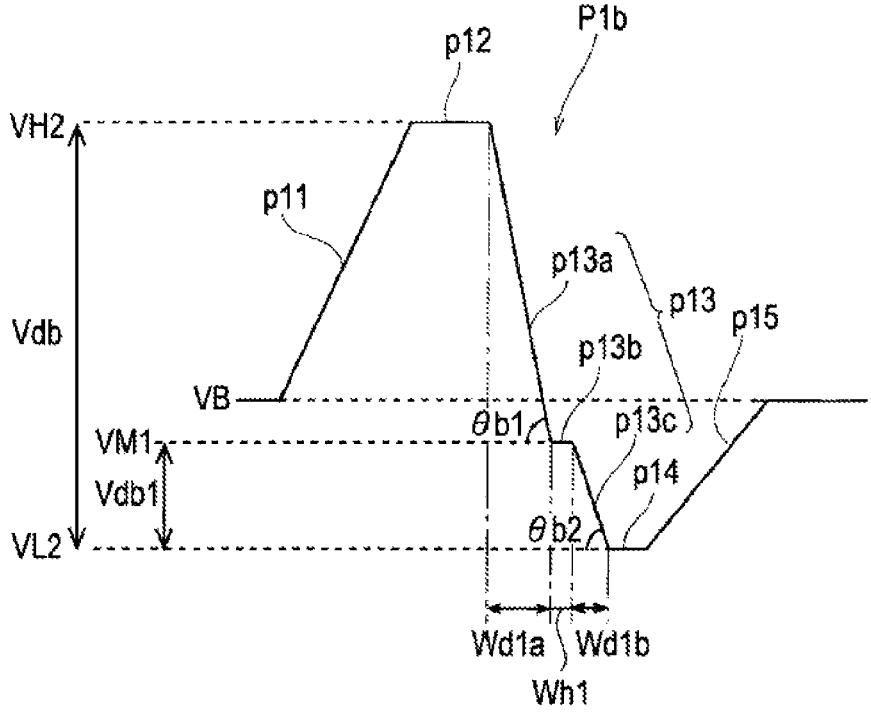
FIG. 6 is a diagram illustrating the waveform structure of a second ejection pulse.

FIG. 6 is a diagram illustrating the waveform structure of the second ejection pulse P1*b* of the first signal COM1.

As shown in FIG. 6, the second ejection pulse P1*b* includes a preliminary expansion section p11 (corresponding to a first variation section), an expansion hold section p12 (corresponding to a hold section), a contraction section p13 (corresponding to a second variation section), a contraction hold section p14, and a return expansion section p15. The preliminary expansion section p11 is a waveform section in which the potential is increased at a constant inclination in the plus direction (corresponding to the first direction) from the reference potential VB to the second expansion potential VH2. The expansion hold section p12 is a waveform section in which the second expansion potential VH2, which is the termination potential of the preliminary expansion section p11, is constant. The contraction section p13 is a waveform section in which the potential is varied (drops) in the minus direction (corresponding to the second direction) from the second expansion potential VH2 to the second contraction potential VL2. The contraction hold section p14 is a waveform section in which the second contraction potential VL2 is constant. The return expansion section p15 is a waveform section in which the potential is returned from the second contraction potential VL2 to the reference potential VB. The reference potential VB is set to have a value corresponding to 35% of the second expansion potential VH2, which is the potential of the expansion hold section p12.

The contraction section p13 includes a first contraction component p13*a* (corresponding to a first variation component) in which the potential is varied (drops) in the minus direction from the second expansion potential VH2, an intermediate hold component p13*b* (corresponding to an intermediate hold component) in which the first intermediate potential VM1, which is the termination potential of the first contraction component p13*a*, holds for a given time, and a second contraction component p13*c* (corresponding to a second variation component) in which the potential is varied (drops) in the minus direction from the first intermediate potential VM1. That is, the contraction section p13 is configured such that the variation in the potential stops only for a short time while the potential is varied from the second expansion potential VH2 to the second contraction potential VL2.

The potential inclination of the first contraction component p13*a* is set to be steeper than the potential inclination of the contraction section p3 in the ejection pulses P1*a* and P2*a* (θb1>θa). The first intermediate potential VM1, which is the potential of the intermediate hold component p13*b*, is set to a value equal to or less than the reference potential VB, and specifically, to a value corresponding to 24% of the second expansion potential VH2, which is the expansion hold section p12. In other words, a potential difference Vdb1 between the first intermediate potential VM1 and the second contraction potential VL2 is set to a value corresponding to 24% of a driving voltage Vdb (which is a potential difference between the second expansion potential VH2, which is the maximum potential, and the second contraction potential VL2, which is the minimum potential) of the second ejection pulse P1*b*. In addition, the potential inclination of the second contraction component p13*c* is set to be gentler than the potential inclination of the first contraction component p13*a* (θb2<θb1). The time from the initial end to the termination end of the intermediate hold component p13*b*, that is, a hold time Wh1 is set to a value in the range of Expression (1) on the assumption that a vibration period of the pressure vibration occurring in the ink of the pressure chamber 25 is Tc.

$$0<Wh1\leqq 0.12\ Tc \tag{1}$$

In addition, a hold time Wd1*b* from the initial end to the termination end of the second contraction component p13*c* is set to a value in the range of Expression (2).

$$Wd1b\geqq 0.08\ Tc \tag{2}$$

In this expression, Tc is uniquely determined depending on the shape, size, rigidity, and the like of each constituent member such as the nozzle 27, the pressure chamber 25, the ink supply port 24, and the piezoelectric vibrator 17. For example, the inherent vibration period Tc can be expressed as Expression (3).

$$Tc=2\pi\sqrt{[((Mn\times Ms)/(Mn+Ms))\times Cc]} \tag{3}$$

In Expression (3), Mn denotes inertance in the nozzle 27, Ms denotes inertance in the ink supply port 24, and Cc denotes the compliance (indicating a variation in the volume per about unit pressure and softness degree) of the pressure chamber 25. In Expression (3), the inertance M indicates that the liquid readily moves in the passage such as the nozzle 27. In other words, the inertance M is the mass of a liquid per unit area. On the assumption that the density of a liquid is ρ, the cross-section area of a surface perpendicular to a downflow direction of a liquid in a passage is S, and the length of the passage is L, the inertance M can be expressed as Expression (4).

$$M=(\rho\times L)/S \tag{4}$$

Tc may not be defined as in Expression (3), but may be a vibration period of the pressure chamber 25 of the print head 2.

Figure 8A:
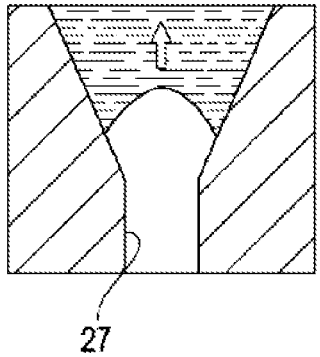
FIGS. 8A to 8D are sectional views illustrating the vicinity of a nozzle to explain movement of a meniscus when ink is ejected from the nozzle.

When the second ejection pulse P1*b* having the above-described structure is supplied to the piezoelectric vibrator 17, the piezoelectric vibrator 17 is first contracted in the element longitudinal direction in the preliminary expansion section p11, and thus the pressure chamber 25 is expanded from a reference volume corresponding to the reference potential VB to an expansion volume corresponding to the second expansion potential VH2 (first variation step). As shown in FIG. 8A, the surface (meniscus) of the ink in the nozzle 27 is considerably drawn toward the pressure chamber 25 (an upper side of the drawing) by this expansion and the ink in the pressure chamber 25 is supplied from the reservoir 23 via the ink supply port 24. Then, the expansion state of the pressure chamber 25 holds for the entire supply period of the expansion hold section p12 (hold step).

Figure 8B:
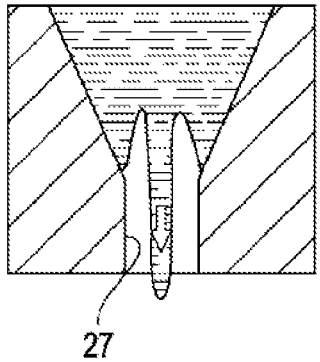

After the expansion state holds by the expansion hold section p12, the contraction section p13 is supplied and thus the piezoelectric vibrator 17 is expanded in response to the supply of the contraction section p13. Then, the pressure chamber 25 is contracted from the expansion volume to a contraction volume corresponding to the second contraction potential VL2 (second variation step). Since the contraction section p13 includes the first contraction component p13*a*, the intermediate hold component p13*b*, and the second contraction component p13*c*, as described above, the pressure chamber 25 is contracted from the expansion volume to a first intermediate volume corresponding to the first intermediate potential VM1 by the first contraction component p13*a* in the second variation action (first variation action). In this way, the ink in the pressure chamber 25 is pressurized, as shown in FIG. 8B, the middle portion of the meniscus is extruded toward the ejection side (a lower side of the drawing), and thus the extruded portion grows in the form of a liquid column.

Figure 8C:
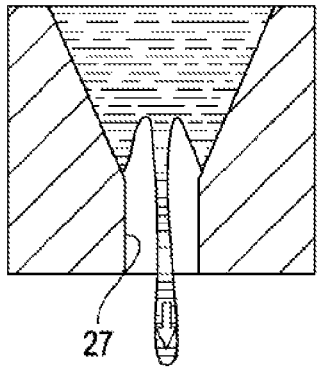

Next, the intermediate hold component p13*b* is supplied, and then the first intermediate volume is held only for the time Wh1 (hold action). Then, the expansion of the piezoelectric vibrator 17 temporarily stops. Meanwhile, as shown in FIG. 8C, the liquid column in the middle portion of the meniscus grows in the ejection direction due to the inertia force. However, since the ink in the pressure chamber 25 is not pressurized for a while, the liquid column is thus suppressed from growing. As a consequence, a flying speed Vm1*b* of a main liquid droplet subsequently ejected is suppressed. In this case, since the potential inclination of the first contraction component p13*a* is set to be steeper than the potential inclination of the contraction section p3 in the ejection pulses P1*a* and P2*a*, the flying speed Vm1*b* of the main liquid droplet is more rapid than a flying speed Vma of the ink ejected by the ejection pulses P1*a* and P2*a*.

Figure 8D:
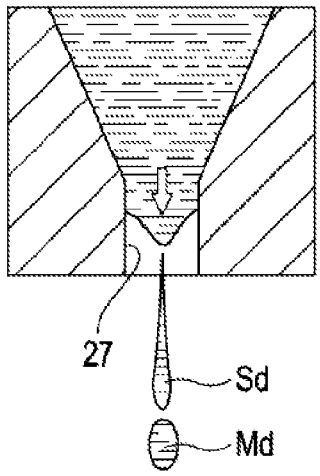

After being held by the intermediate hold component p13*b*, the piezoelectric vibrator 17 is expanded more slowly by the second contraction component p13*c* than by the first contraction component p13*a*, and then the volume of the pressure chamber 25 is pressurized from the first intermediate volume to the contraction volume (second variation action). That is, the variation speed of the volume of the pressure chamber in the second variation action is slower than the variation speed of the volume of the pressure chamber in the first variation action. In this way, as shown in FIG. 8D, the entire meniscus is extruded in the ejection direction and the rear end portion of the liquid column is gradually accelerated. Then, the liquid column is separated from the meniscus, the separated portion is ejected as an ink droplet from the nozzle 27, and the separated portion flies. The ejected ink droplet is formed by a preceding main liquid droplet Md and a subsequent satellite liquid droplet Sd separated from the main liquid droplet Md.

The second ejection pulse P1*b* of the first signal COM1 is used to eject the black ink, which is self-dispersion type pigment ink where a tailed portion is not easily generated. Therefore, by permitting the potential inclination of the first contraction component p13*a* to be steep, the tailed portion does not occur easily even when the flying speed of the ink is increased. Moreover, in this embodiment, the liquid column in the middle portion of the meniscus is extruded toward the ejection side by pressurizing the ink in the pressure chamber 25 by the first contraction component p13*a* and the pressurization of the ink in the pressure chamber 25 temporarily holds by the intermediate hold component p13*b*, and then the rear end portion of the liquid column becoming the satellite liquid droplet Sd is gradually accelerated by the second contraction component p13*c*. Therefore, the main liquid droplet Md and the satellite liquid droplet Sd ejected from the nozzle 27 fly in the integrated state. In this way, a dot formed when the main liquid droplet and the satellite liquid droplet are landed on the print surface of the print medium comes to have a form close to a circle or an ellipse.

After the contraction section p13, the contraction state of the pressure chamber 25 holds for a given time by the contraction hold section p14. Meanwhile, the pressure of the ink in the pressure chamber 25, which is decreased by the ejection of the ink, is increased again by the inherent vibration. The return expansion section p15 is applied to the piezoelectric vibrator 17 at the time at which the pressure of the ink is increased, and thus the pressure chamber 25 is slowly expanded from the contraction volume to the normal volume. Then, the pressure variation (residual vibration) of the ink in the pressure chamber 25 is reduced.

Figure 7:
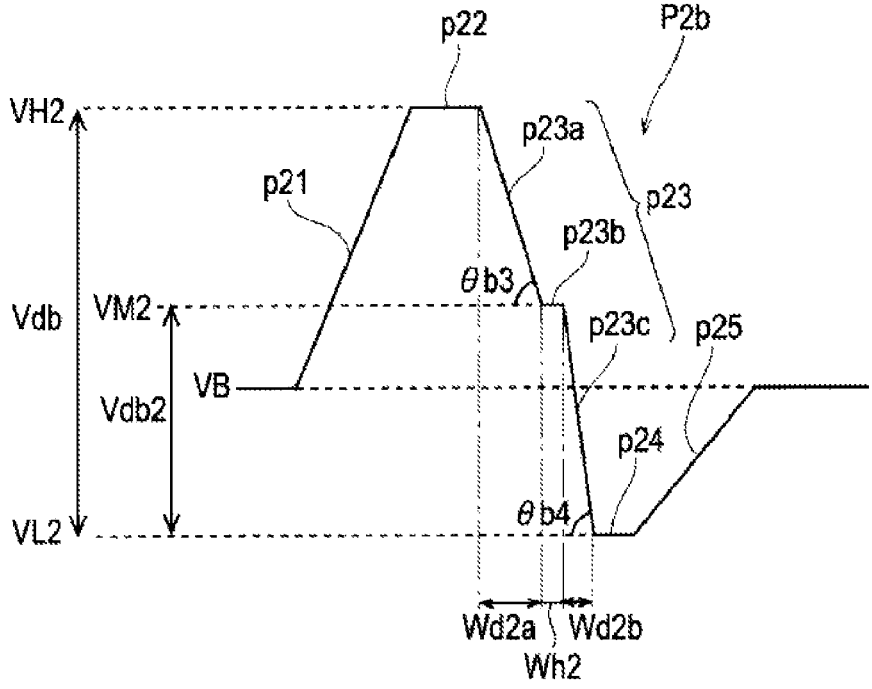
FIG. 7 is a diagram illustrating the waveform structure of a fourth ejection pulse.

FIG. 7 is a diagram illustrating the waveform structure of the fourth ejection pulse P2*b* of the second signal COM2.

Like the second ejection pulse P1*b*, as shown in FIG. 7, the fourth ejection pulse P2*b* includes a preliminary expansion section p21 (corresponding to the first variation section), an expansion hold section p22 (corresponding to the hold section), a contraction section p23 (corresponding to the second variation section), a contraction hold section p24, and a return expansion section p25. The basic waveform structure of the fourth ejection pulse P2*b* is nearly the same as that of the second ejection pulse P1*b*, but the structure of the contraction section p23 is different.

The contraction section p23 includes a first contraction component p23*a* (corresponding to a first variation component) in which the potential is varied (drops) in the minus direction from the second expansion potential VH2, an intermediate hold component p23*b* (corresponding to the intermediate hold component) in which the second intermediate potential VM2, which is the termination potential of the first contraction component p23*a*, holds for a given time, and a second contraction component p23*c* (corresponding to the second variation component) in which the potential is varied (drops) in the minus direction from the second intermediate potential VM2.

The potential inclination of the first contraction component p23*a* is steeper than the potential inclination of the contraction section p3 in the ejection pulses P1*a* and P2*a* ($\theta b3>\theta a$) and gentler than the potential inclination of the first contraction component p13*a* of the second ejection pulse P1*b* ($\theta b3<\theta b1$). The second intermediate potential VM2, which is the potential of the intermediate hold component p23*b*, is higher than the first intermediate potential VM1. Specifically, the second intermediate potential VM2 is set to a value corresponding to 55% of the second expansion potential VH2, which is the expansion hold section p22. In other words, a potential difference Vdb2 between the second intermediate potential VM2 and the second contraction potential VL2 is set to a value corresponding to 55% of the driving voltage Vdb of the second ejection pulse P2*b*. The potential inclination of the second contraction component p23*c* is set to be higher than the potential inclination of the first contraction component p23*a* ($\theta b4<\theta b3$). The time from the initial end to the termination end of the intermediate hold component p23*b*, that is, a hold time Wh2 is set to a value in the range of Expression (5)

$$0<Wh2\leqq 0.12\ Tc \quad (5)$$

In addition, a hold time Wd2*b* from the initial end to the termination end of the second contraction component p23*c* is set to a value in the range of Expression (6).

$$Wd2b\geqq 0.08\ Tc \quad (6)$$

When the fourth ejection pulse P2*b* having the above-described structure is supplied to the piezoelectric vibrator 17, the piezoelectric vibrator 17 is first contracted in the element longitudinal direction in the preliminary expansion section p21, and thus the pressure chamber 25 is expanded from the reference volume corresponding to the reference potential VB to the expansion volume corresponding to the second expansion potential VH2 (first variation step). The meniscus of the ink in the nozzle 27 is considerably drawn toward the pressure chamber 25 by this expansion and the ink in the pressure chamber 25 is supplied from the reservoir 23 via the ink supply port 24. Then, the expansion state of the pressure chamber 25 holds for the entire supply period of the expansion hold section p22 (hold step).

After the expansion state holds by the expansion hold section p22, the contraction section p23 is supplied and thus the piezoelectric vibrator 17 is expanded in response to the supply of the expansion section p23. Then, the pressure chamber 25 is contracted from the expansion volume to the contraction volume corresponding to the second contraction potential VL2 (second variation step). Since the contraction section p23 of the fourth ejection pulse P2*b* includes the first contraction component p23*a*, the intermediate hold component p23*b*, and the second contraction component p23*c*, the pressure chamber 25 is contracted from the expansion volume to the second intermediate volume corresponding to the second intermediate potential VM2 by the first contraction component p23*a* in the second variation step (first variation action). In this way, the ink in the pressure chamber 25 is pressurized, the middle portion of the meniscus is extruded toward the ejection side, and thus the extruded portion grows in the form of a liquid column.

Next, the intermediate hold component p23*b* is supplied, and then the second intermediate volume is held only for the time Wh2 (hold action). Then, the expansion of the piezoelectric vibrator 17 temporarily stops. Meanwhile, the liquid column in the middle portion of the meniscus grows in the ejection direction due to the inertia force. However, since the ink in the pressure chamber 25 is not pressurized for a while, the liquid column is thus suppressed from growing. As a consequence, a flying speed Vm2*b* of a main liquid droplet subsequently ejected is suppressed. In this case, since the potential inclination of the first contraction component p23*a* is set to be steeper than the potential inclination of the contraction section p3 in the ejection pulses P1*a* and P2*a*, the flying speed Vm2*b* of the main liquid droplet is more rapid than the flying speed Vma of the ink ejected by the ejection pulses P1*a* and P2*a*.

After being held by the intermediate hold component p23*b*, the piezoelectric vibrator 17 is expanded more rapidly by the second contraction component p23*c* than by the first contraction component p23*a*, and then the volume of the pressure chamber 25 is rapidly pressurized from the second intermediate volume to the contraction volume (second variation action). That is, the variation speed of the volume of the pressure chamber in the second variation action is more rapid than the variation speed of the volume of the pressure chamber in the first variation action. In this way, the entire meniscus is extruded in the ejection direction and the rear end portion of the liquid column is accelerated. Then, the liquid column is separated from the meniscus, the separated portion is ejected as an ink droplet from the nozzle 27, and the separated portion flies. The ejected ink droplet is formed by the preceding main liquid droplet Md and the subsequent satellite liquid droplet Sd separated from the main liquid droplet Md.

In this embodiment, after the liquid column in the middle portion of the meniscus is extruded to the ejection side by pressurizing the ink in the pressure chamber 25 by the first contraction component p23*a* (first variation action), the pressurization of the ink in the pressure chamber 25 temporarily holds by the intermediate hold component p23*b* (hold action). Therefore, the flying speed of the main liquid droplet Md is suppressed. On the contrary, the rear end portion of the liquid column becoming the satellite liquid droplet Sd is accelerated by the second contraction component p23*c*. Therefore, the flying speed of the main liquid droplet Md is more rapid than the flying speed of the satellite liquid droplet Sd. In this way, while the liquid droplet is ejected from the nozzle 27 and is landed on the print surface of the print medium, the satellite liquid droplet Sd approaches the main liquid droplet Md. Therefore, the tailed portion is suppressed even upon ejecting the ink where the tailed portion occurs relatively easily like the color ink as the resin-dispersion type pigment ink, and thus a dot formed when the main liquid droplet and the satellite liquid droplet are landed on the print surface of the print medium comes to have a form close to a circle or an ellipse.

After the contraction section p23, the contraction state of the pressure chamber 25 holds for a given time by the contraction hold section p24. Meanwhile, the pressure of the ink in the pressure chamber 25, which is decreased by the ejection of the ink, is increased again by the inherent vibration. The return expansion section p5 is applied to the piezoelectric vibrator 17 at the time at which the pressure of the ink is increased, and thus the pressure chamber 25 is gradually expanded from the contraction volume to the normal volume. Then, the pressure variation (residual vibration) of the ink in the pressure chamber 25 is reduced.

Figure 9:
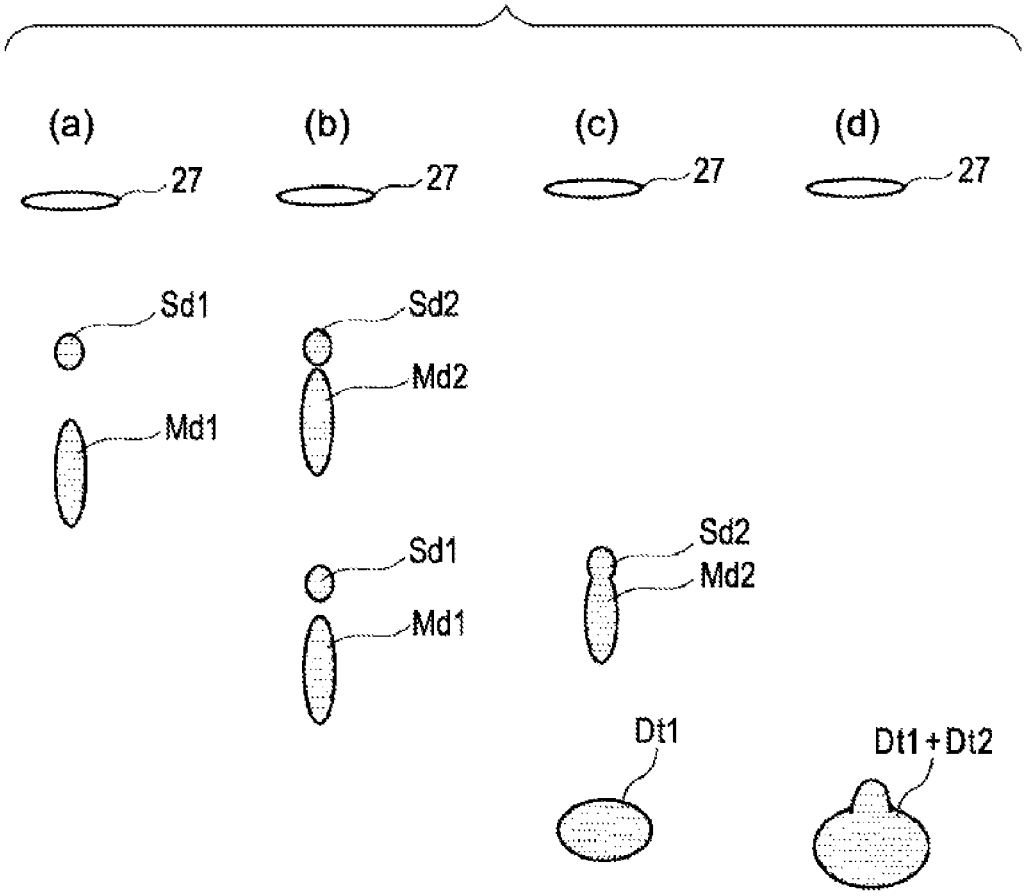
FIG. 9 is a schematic view illustrating the forms of flying of liquid droplets when ink is ejected toward a print medium from a nozzle.

FIG. 9 is a schematic view illustrating large dots formed on the print medium when the preceding ejection pulses (the first ejection pulse P1*a* and the third ejection pulse P2*a*) first generated in the unit period T and the liquid-kind ejection pulses (the second ejection pulse P1*b* and the fourth ejection pulse P2*b*) subsequent to the preceding ejection pulses are sequentially applied to the piezoelectric vibrator 17 using the driving signal COM to eject the ink continuously from the nozzle 27.

First, by applying the preceding ejection pulses to the piezoelectric vibrator 17, as shown in a part (a) of FIG. 9, first ink is ejected from the nozzle 27. The preceding first ink is formed by a main liquid droplet Md1 and a satellite liquid droplet Sd1. Next, by applying the liquid-kind ejection pulses to the piezoelectric vibrator 17, as shown in a part (b) of FIG. 9, second ink is ejected from the nozzle 27. The second ink subsequent to the first ink is also formed by a main liquid droplet Md2 and a satellite liquid droplet Sd2. The satellite liquid droplet Sd2 ejected by the liquid-kind ejection pulse approaches the main liquid droplet Md2 while the satellite liquid droplet Sd2 flies toward the print medium. As shown in a part (c) of FIG. 9, the satellite liquid droplet Sd2 is finally integrated with the main liquid droplet Md2. The flying speeds (Vm1*b* and Vm2*b*) of the main liquid droplet Md2 of the second ink is more rapid than the flying speed Vma of the ink ejected by the preceding ejection pulse. Therefore, the second ink approaches the first ink, while flying toward the print medium. As shown in a part (d) of FIG. 9, the first ink is landed on the print medium and thus a dot Dt1 is formed. Then, the second ink is landed on a position close to the dot Dt1 and is integrated. As a consequence, a large dot (Dt1+Dt2) is formed on the print medium.

In this way, when the ink (black ink) where the tailed portion hardly occurs is ejected, the first signal COM1 is used. When the ink (color ink) where the tailed portion easily occurs is ejected, the second signal COM2 is used. Therefore, the forms of dots on the landing target can be arranged constantly, irrespective of the kinds of ink. That is, compared to the case where the black ink where the tailed portion does not easily occur is ejected by the second ejection pulse P1*b* of the first signal COM1, the flying speed of the main liquid droplet Md when the color ink where the tailed portion easily occurs is ejected by the fourth ejection pulse P2*b* of the second signal COM2 is reduced. Moreover, the flying speed of the satellite liquid droplet Sd can be made more rapid than the flying speed of the main liquid droplet Md. In this way, even in the color ink where the tailed portion easily occurs, the distance between the main liquid droplet and the satellite liquid droplet can be decreased while the main liquid droplet and the satellite liquid droplet are landed on the landing target. Therefore, the tailed portion is suppressed. As a consequence, the difference between the landing positions of the main liquid droplet and the satellite liquid droplet on the landing target is suppressed. Accordingly, the forms of dots on the landing target can be arranged constantly, irrespective of the kinds of ink.

In this embodiment, when the preceding ejection pulses and the liquid-kind ejection pulses are continuously applied to the piezoelectric vibrator 17 in the unit period T to eject the ink from the nozzle 27, the preceding first ink and the subsequent second ink are integrated to each other on the landing target. Therefore, the difference between the landing positions on the landing target is suppressed. Accordingly, in the configuration in which gray scale expression is realized in accordance with the number of ink ejected in the unit period T, the quality of a printed image can be improved.

In this embodiment, an interval Δt1 between the first ejection pulse P1*a*, which is the preceding ejection pulse, and the second ejection pulse P1*b*, which is the liquid-kind ejection pulse, in the first signal COM1 is set to be in the range from 1.4 Tc to 1.6 Tc. By setting this interval in this way, the ink can be effectively ejected by the second ejection pulse P1*b* using the residual vibration upon ejecting the ink by the first ejection pulse P1*a*. On the other hand, the interval between the third ejection pulse P2*a*, which is the preceding ejection pulse, and the fourth ejection pulse P2*b*, which is the liquid-kind ejection pulse, in the second signal COM2 is set to be in the range from 1.1 Tc to 1.2 Tc. By setting this interval in this way, the ejection of the liquid by the fourth ejection pulse P2*b* is configured to start in a state (state where the vibration is not strong or is not weak) where the influence of the residual vibration occurring upon ejecting the ink by the third ejection pulse P2*a* is as small as possible. In this way, the flying speed of the ink (particularly, the main liquid droplet) ejected by the fourth ejection pulse P2*b* in the second signal COM2 can be suppressed from being increased due to the influence of the residual vibration after the ink is ejected by the third ejection pulse P2*a*. Accordingly, the tailed portion occurring upon ejecting the color ink can be further suppressed.

The invention is not limited to the above-described embodiment, but may be modified in various forms within the scope described in the appended claims.

The waveform structure of the second ejection pulse P1*b* is not limited to the structure exemplified in the embodiment. The ejection driving pulse may be a voltage waveform that includes at least: the first variation section in which the potential is varied in the first direction to vary the volume of the pressure chamber 25; the hold section in which the volume of the pressure chamber 25 varied in the first variation section holds for a given time and the termination potential of the first variation section is constant; and the second variation section in which the potential is varied in the second direction opposite to the first direction to vary the volume of the pressure chamber 25 varied in the first variation section.

In the above-described embodiment, the so-called vertical vibration mode piezoelectric vibrator 17 is used as a pressure generation unit. However, the invention is not limited thereto. For example, a bending vibration mode piezoelectric element may be used. In this case, the exemplified ejection driving pulse DP becomes a waveform reversed in the potential variation direction, that is, a waveform of which the upper and lower portions are reversed.

The invention is not limited to a printer, but is applicable to any liquid ejecting apparatus capable of controlling ejection using a plurality of driving signals. Examples of the liquid ejecting apparatus include various kinds of ink jet printing apparatuses such as a plotter, a facsimile apparatus, and a copy apparatus, a display manufacturing apparatus, an electrode manufacturing apparatus, and a chip manufacturing apparatus. In the display manufacturing apparatus, liquids of various color materials of R (Red), G (Green), and B (Blue) are ejected from a color material ejecting head. In the electrode manufacturing apparatus, a liquid-like electrode material is ejected from an electrode material ejecting head. In the chip manufacturing apparatus, a bio-organism liquid is ejected from a bio-organism ejecting head.

What is claimed is:

1. A liquid ejecting apparatus comprising:

a liquid ejecting head which includes a nozzle ejecting a liquid, a pressure chamber communicating with the nozzle, and a pressure generation unit applying pressure variation to the liquid of the pressure chamber and which ejects the liquid from the nozzle by an operation of the pressure generation unit;

a driving control unit which generates a driving signal containing an ejection pulse used to eject the liquid from the nozzle and controls driving of the pressure generation unit; and a movement unit which moves the liquid ejecting head relative to a landing target, wherein a first liquid and a second liquid different from the first liquid are ejected, wherein the driving signal includes a first signal used to eject the first liquid and not used to eject the second liquid and a second signal used to eject the second liquid and not used to eject the first liquid, wherein the first and second signals each include a liquid-kind ejection pulse having a first variation section in which a potential is varied in a first direction, a hold section in which a termination potential of the first variation section holds for a given time, and a second variation section in which the potential is varied in a second direction opposite to the first direction, wherein the second variation section includes a first variation component in which the potential is varied in the second direction from the termination potential of the first variation section, an intermediate hold component in which the termination potential of the first variation component holds for a given time, and a second variation component in which the potential is varied in the second direction from the termination potential of the first variation component, wherein a potential inclination of the second variation component in the liquid-kind ejection pulse of the first signal is gentler than a potential inclination of the first variation component, wherein a potential inclination of the second variation component in the liquid-kind ejection pulse of the second signal is steeper than the potential inclination of the first variation component, and wherein a ratio of the potential of the intermediate hold component to the potential of the hold section is larger in the liquid-kind ejection pulse of the second signal than in the liquid-kind ejection pulse of the first signal.

2. The liquid ejecting apparatus according to claim 1, wherein the first and second signals each include a preceding ejection pulse generated first and the liquid-kind ejection pulse subsequent to the preceding ejection pulse in a unit period separated by a timing signal defining a repetition period of the driving signal, and wherein a flying speed of the liquid ejected by the preceding ejection pulse is set to be slower than a flying speed of the liquid ejected by the liquid-kind ejection pulse, and the liquid ejected by the preceding ejection pulse and the liquid ejected by the liquid-kind ejection pulse are integrated to each other on the landing target.

3. The liquid ejecting apparatus according to claim 2, wherein an interval between the preceding ejection pulse and the liquid-kind ejection pulse of the first signal is in the range from 1.4 Tc to 1.6 Tc, and wherein an interval between the preceding ejection pulse and the liquid-kind ejection pulse of the second signal is in the range from 1.1 Tc to 1.2 Tc.

4. The liquid ejecting apparatus according to claim 1, wherein the first liquid is a liquid to which a self-dispersion type pigment is added, and wherein the second liquid is a liquid to which a resin dispersion type pigment and a dispersion agent is added.

5. The liquid ejecting apparatus according to claim 1, wherein for the second signal for the second liquid the first variation section rises from a reference potential to first potential, the hold section holds at the first potential, the first variation component falls from the first potential to the intermediate hold component at a third potential that is in between the reference potential and the second potential, the intermediate hold component falls to a fourth potential that is less than the reference component.

* * * * *